US008264425B2

(12) United States Patent
Park et al.

(10) Patent No.: US 8,264,425 B2
(45) Date of Patent: Sep. 11, 2012

(54) METHOD FOR COMPENSATING DATA, DATA COMPENSATING APPARATUS FOR PERFORMING THE METHOD AND DISPLAY APPARATUS HAVING THE DATA COMPENSATING APPARATUS

(75) Inventors: Bong-Im Park, Cheonan-si (KR); Bong-Ju Jun, Cheonan-si (KR); Jong-Hyon Park, Cheonan-si (KR); Yun-Jae Kim, Asan-si (KR); Jae-Won Jeong, Seoul (KR); Woo-Young Lee, Daegu (KR); Kang-Hyun Kim, Seoul (KR)

(73) Assignee: Samsung Electronics Co., Ltd. (KR)

( * ) Notice: Subject to any disclaimer, the term of this patent is extended or adjusted under 35 U.S.C. 154(b) by 551 days.

(21) Appl. No.: 12/555,141

(22) Filed: Sep. 8, 2009

(65) Prior Publication Data

US 2010/0156951 A1 Jun. 24, 2010

(30) Foreign Application Priority Data

Dec. 24, 2008 (KR) ..... 2008-133747

(51) Int. Cl.
*G09G 3/28* (2006.01)

(52) U.S. Cl. ..... 345/69; 345/98; 345/89

(58) Field of Classification Search ..... None
See application file for complete search history.

(56) References Cited

U.S. PATENT DOCUMENTS 7,592,995 B2 * 9/2009 Sugino et al. ..... 345/101
2007/0285371 A1 * 12/2007 Nam et al. ..... 345/98

FOREIGN PATENT DOCUMENTS

JP 2003-172915 A 6/2003
JP 2005-070582 A 3/2005
KR 1020060038080 A 5/2006
KR 10-0853210 B1 8/2008

* cited by examiner

*Primary Examiner* — Muhammad N Edun
(74) *Attorney, Agent, or Firm* — Cantor Colburn LLP

(57) ABSTRACT

A method for compensating data for a data compensating apparatus in a display apparatus includes converting image data of an n-th frame (where "n" is a natural number) into pre-compensation data of the n-th frame having a gray scale less than or equal to a gray scale of the image data of the n-th frame based on pre-compensation data of an (n−1)-th frame, storing the pre-compensation data of the n-th frame, and generating compensation data of the n-th frame having a gray scale greater than or equal to the gray scale of the image data of the n-th frame by using the image data of the n-th frame and the pre-compensation data of the (n−1)-th frame.

13 Claims, 9 Drawing Sheets

FIG. 8

| F(n) \ F(n-1) | Fn-128 | Fn-120 | Fn-112 | Fn-104 | Fn-96 | Fn-88 | Fn-80 | Fn-72 | Fn-64 | Fn-56 | Fn-48 | Fn-40 | Fn-32 | Fn-24 | Fn-16 | Fn-8 | Fn |
|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 0 |
| 64 | 64 | 64 | 64 | 64 | 64 | 64 | 64 | 64 | 64 | 64 | 64 | 64 | 64 | 64 | 64 | 64 | 64 |
| 128 | 96 | 98 | 100 | 102 | 104 | 106 | 108 | 110 | 112 | 114 | 116 | 118 | 120 | 122 | 124 | 126 | 128 |
| 192 | 164 | 166 | 167 | 169 | 170 | 172 | 173 | 175 | 176 | 178 | 180 | 182 | 184 | 186 | 188 | 190 | 192 |
| 256 | 228 | 230 | 231 | 233 | 234 | 236 | 237 | 239 | 240 | 242 | 244 | 246 | 248 | 250 | 252 | 254 | 256 |
| 320 | 229 | 297 | 297 | 298 | 298 | 299 | 299 | 300 | 300 | 303 | 305 | 308 | 310 | 313 | 315 | 318 | 320 |
| 384 | 356 | 357 | 358 | 359 | 360 | 361 | 362 | 363 | 364 | 367 | 369 | 372 | 374 | 377 | 379 | 382 | 384 |
| 448 | 436 | 436 | 436 | 436 | 436 | 436 | 436 | 436 | 436 | 436 | 436 | 436 | 436 | 440 | 440 | 444 | 448 |
| 512 | 496 | 496 | 496 | 496 | 496 | 496 | 496 | 496 | 496 | 496 | 496 | 496 | 496 | 496 | 504 | 508 | 512 |
| 576 | 556 | 556 | 556 | 556 | 556 | 556 | 556 | 556 | 556 | 556 | 556 | 556 | 556 | 556 | 576 | 576 | 576 |
| 640 | 576 | 576 | 576 | 576 | 576 | 576 | 576 | 576 | 584 | 608 | 612 | 612 | 616 | 624 | 632 | 640 | 640 |
| 704 | 620 | 620 | 620 | 620 | 620 | 652 | 652 | 620 | 620 | 620 | 660 | 668 | 676 | 684 | 692 | 700 | 704 |
| 768 | 660 | 680 | 700 | 708 | 708 | 708 | 708 | 712 | 712 | 720 | 724 | 732 | 740 | 748 | 756 | 764 | 768 |
| 832 | 728 | 732 | 736 | 744 | 752 | 760 | 760 | 768 | 772 | 780 | 788 | 796 | 804 | 812 | 820 | 828 | 832 |
| 896 | 800 | 800 | 804 | 808 | 808 | 816 | 816 | 832 | 848 | 852 | 856 | 860 | 868 | 876 | 884 | 892 | 896 |
| 960 | 872 | 872 | 876 | 876 | 880 | 880 | 880 | 896 | 928 | 928 | 932 | 936 | 936 | 944 | 952 | 960 | 960 |
| 1020 | 1023 | 1023 | 1023 | 1023 | 1203 | 1023 | 1023 | 1023 | 1023 | 1023 | 1023 | 1023 | 1023 | 1023 | 1023 | 1023 | 1011 |

METHOD FOR COMPENSATING DATA, DATA COMPENSATING APPARATUS FOR PERFORMING THE METHOD AND DISPLAY APPARATUS HAVING THE DATA COMPENSATING APPARATUS

This application claims priority to Korean Patent Application No. 2008-133747, filed on Dec. 24, 2008, and all the benefits accruing therefrom under 35 U.S.C. §119, the contents of which in its entity are herein incorporated by reference.

BACKGROUND OF THE INVENTION

1. Field of the Invention

The present invention relates to a method for compensating data, a data compensating apparatus for performing the method, and a display apparatus having the data compensating apparatus.

2. Description of the Related Art

Generally, a liquid crystal display ("LCD") apparatus includes an array substrate, an opposite substrate facing the array substrate, and liquid crystal material having an anisotropic refractive index interposed between the array substrate and the opposite substrate. The LCD apparatus displays an image by controlling a strength of an electric field applied to the liquid crystal material to control an amount of light transmitted through the liquid crystal material.

The LCD apparatus typically uses dynamic capacitance compensation ("DCC") for improving a response time of the liquid crystal material. DCC compensates a present frame data signal using a previous frame data signal to improve the response time of liquid crystal. For example, when a gray scale of the present frame data signal is much larger than a gray scale of the previous frame data signal, DCC overshoots the gray scale of the present frame data signal, e.g., outputs a higher gray scale than the gray scale of the present frame data signal, to improve a rising response time of the liquid crystal material. In contrast, when the gray scale of the present frame data signal is much lower than the gray scale of the previous frame data signal, DCC overshoots the gray scale of the present frame data signal to a lower gray scale than the gray scale of the present frame data signal, to improve a falling response time of the liquid crystal material.

FIG. 1 is a graph of display signals versus time (in frames) showing response characteristics of liquid crystal implementing DCC of the prior art. FIG. 2 is a diagram illustrating rising bounce characteristics of the liquid crystal implementing DCC of the prior art.

Referring to FIG. 1, which is a graph illustrating results of measuring the response characteristics of the liquid crystal when a zero gray scale data signal 0G is received for a previous frame F(n−1) and a 224 gray scale data signal 224G is received for a present frame F(n), based on an 8-bit data signal for a 46-inch display panel (120 Hz driving) with DCC technology. The DCC is applied to the 224 gray scale data signal 224G of the present frame F(n), and the 224 gray scale data signal 224G is compensated to a DCC level, which is higher than a level of the input data, as shown in FIG. 1. Accordingly, when the DCC level is applied to the present frame F(n), a luminance level in subsequent frames drops based on the response characteristics of the liquid crystal, as shown by the rising bounce from an (n+1)-th frame F(n+1) to an (n+6)-th frame F(n+6). Thus, it can be seen that a time required for the luminance level to recover, e.g., to reach the input data level of the data signal, is about seven to eight frames.

Referring to FIG. 2, the rising bounce shown in FIG. 1 substantially degrades a display quality, as shown by a visible blurring behind an edge of a scrolling box pattern BP.

BRIEF SUMMARY OF THE INVENTION

Exemplary embodiments of the present invention provide a method for compensating data for substantially improving display quality of a display apparatus.

Exemplary embodiments of the present invention also provide a data compensating apparatus for performing the method.

Exemplary embodiments of the present invention also provide a display apparatus having the data compensating apparatus for performing the method.

According to an exemplary embodiment, a method for compensating data includes converting image data of an n-th frame (where "n" is a natural number) into pre-compensation data of the n-th frame having a gray scale less than or equal to a gray scale of the image data of the n-th frame based on pre-compensation data of an (n−1)-th frame, storing the pre-compensation data of the n-th frame, and generating compensation data of the n-th frame having a gray scale greater than or equal to the gray scale of the image data of the n-th frame by using the image data of the n-th frame and the pre-compensation data of the (n−1)-th frame.

According to an alternative exemplary embodiment, a data compensating apparatus includes a pre-compensating part, a storage part and a compensating part. The pre-compensating part converts image data of an n-th frame (where "n" is a natural number) into pre-compensation data of the n-th frame having a gray scale less than or equal to a gray scale of the image data of the n-th frame based on a pre-compensation data of an (n−1)-th frame. The storage part stores the pre-compensation data of the n-th frame. The compensating part generates compensation data of the n-th frame having a gray scale greater than or equal to the gray scale of the image data of the n-th frame by using the image data of the n-th frame and the pre-compensation data of the (n−1)-th frame.

According to exemplary embodiment, a display apparatus includes a display panel, a data compensating part, a data driving part and a gate driving part. The display panel displays an image. The data compensating part includes a pre-compensating part which converts image data of an n-th frame (where "n" is a natural number) into pre-compensation data of the n-th frame having a gray scale less than or equal to a gray scale of the image data of the n-th frame based on pre-compensation data of an (n−1)-th frame, a storage part which stores the pre-compensation data of the n-th frame, and a compensating part which generates compensation data of the n-th frame having a gray scale greater than or equal to the gray scale of the image data of the n-th frame by using the image data of the n-th frame and the pre-compensation data of the (n−1)-th frame. The data driving part converts the compensation data of the n-th frame into an analog data signal to output the analog data signal to the display panel. The gate driving part outputs a gate signal to the display panel in synchronization with the output of the analog data signal of the data driving part.

Thus, according to exemplary embodiments, when image data rapidly changes from a lower gray scale to a higher gray scale, compensation data of a present frame is generated using pre-compensation data having a gray scale which gradually increases, and a rising bounce characteristic of a liquid crystal is thereby substantially improved.

BRIEF DESCRIPTION OF THE DRAWINGS

The above and other aspects, features and advantages of the present invention will become more readily apparent by describing in further detail exemplary embodiments thereof with reference to the accompanying drawings, in which:

FIG. 8 is an exemplary embodiment of a second LUT part of the data compensating part shown in FIG. 5;

DETAILED DESCRIPTION OF THE INVENTION

Figure 1:
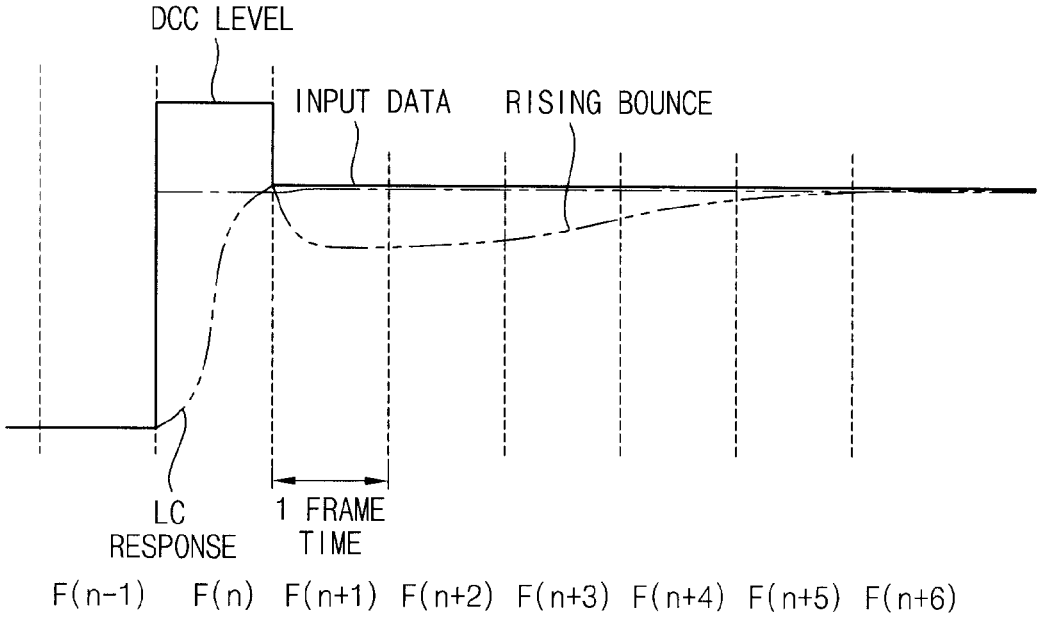
FIG. 1 (PRIOR ART)
FIG. 1 is a graph of display signals versus time (in frames) showing response characteristics of liquid crystal implementing dynamic capacitance compensation ("DCC") technology of the prior art.
Figure 2:
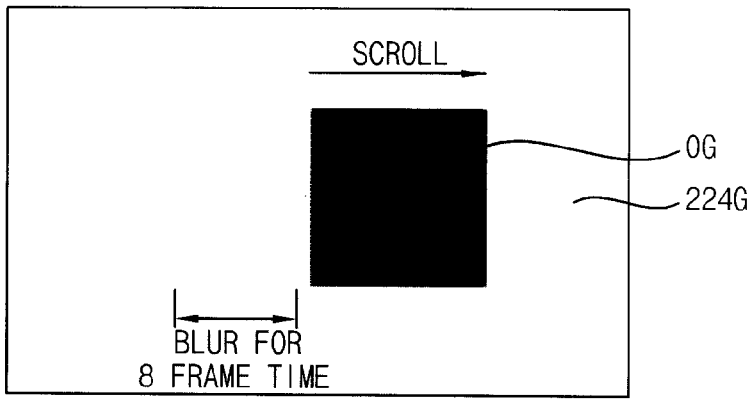
FIG. 2 (PRIOR ART)
FIG. 2 is a diagram illustrating rising bounce characteristics of the liquid crystal implementing the DCC technology of the prior art.

The invention will now be described more fully hereinafter with reference to the accompanying drawings, in which exemplary embodiments of the invention are shown. The present invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including," when used in this specification, specify the presence of stated features, regions, integers, steps, operations, elements and/or components, but do not preclude the presence or addition of one or more other features, regions, integers, steps, operations, elements, components and/or groups thereof.

Furthermore, relative terms, such as "lower" or "bottom" and "upper" or "top" may be used herein to describe one element's relationship to other elements as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on the "upper" side of the other elements. The exemplary term "lower" can, therefore, encompass both an orientation of "lower" and "upper," depending upon the particular orientation of the figure. Similarly, if the device in one of the figures were turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning which is consistent with their meaning in the context of the relevant art and the present disclosure, and will not be interpreted in an idealized or overly formal sense unless expressly so defined herein.

Exemplary embodiments of the present invention are described herein with reference to cross section illustrations which are schematic illustrations of idealized embodiments of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes which result, for example, from manufacturing. For example, a region illustrated or described as flat may, typically, have rough and/or nonlinear features. Moreover, sharp angles which are illustrated may be rounded. Thus, the regions illustrated in the figures are schematic in nature and their shapes are not intended to illustrate the precise shape of a region and are not intended to limit the scope of the present invention.

Hereinafter, exemplary embodiments of the present invention will be described in further detail with reference to the accompanying drawings.

Figure 3:
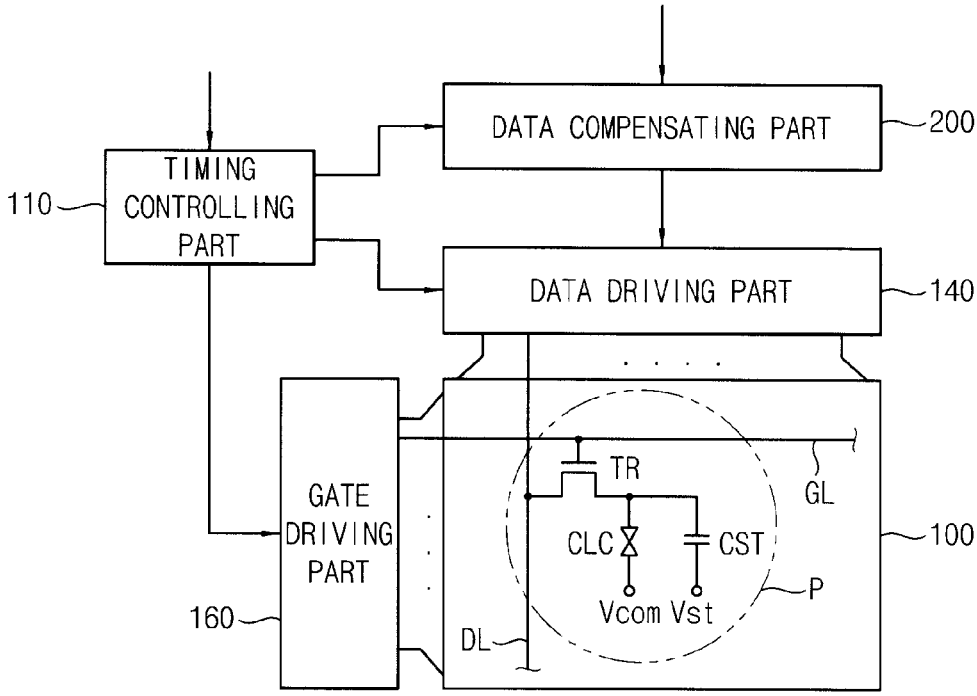
FIG. 3 is a block diagram of an exemplary embodiment of a display apparatus according to the present invention.
Figure 4:
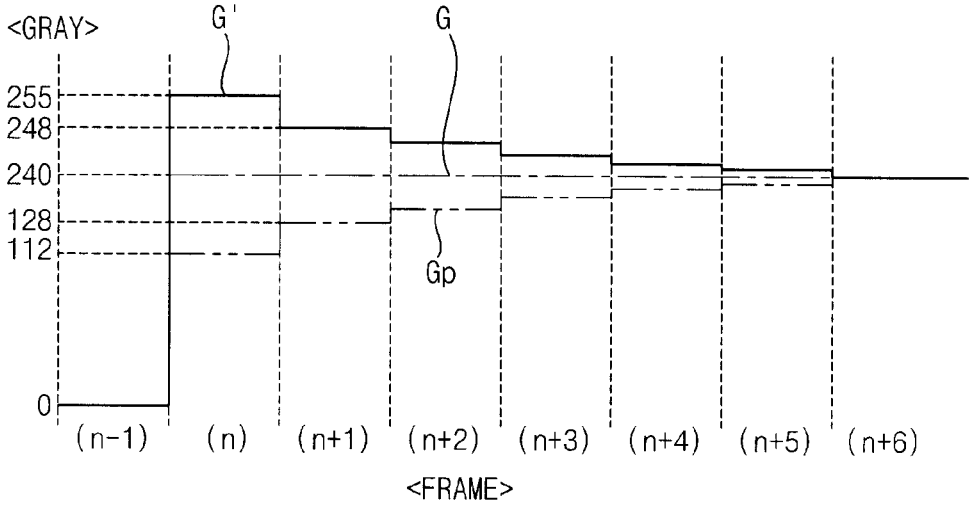
FIG. 4 is a diagram of gray scale values over time (in frames) illustrating an exemplary embodiment of a driving method of a data compensating part of the display apparatus shown in FIG. 3.

FIG. 3 is a block diagram of an exemplary embodiment of a display apparatus according to the present invention. FIG. 4 is a diagram of gray scale values over time (in frames) illustrating an exemplary embodiment of a driving method of a data compensating part of the display apparatus shown in FIG. 3.

Referring to FIGS. 3 and 4, a display apparatus according to an exemplary embodiment includes a display panel 100, a timing controlling part 110, a data compensating apparatus 200 (hereinafter referred to as a "data compensating part 200"), a data driving part 140 and a gate driving part 160.

The display panel 100 includes M data lines DL, N gate lines GL, and m×n pixels P which display an image. In an exemplary embodiment, M, N, m and n are natural numbers. Each of the pixels P includes a transistor TR connected to the gate line GL and the data line DL, a liquid crystal capacitor CLC connected to the transistor and a storage capacitor CST.

The timing controlling part 110 generates a timing control signal for controlling a driving timing of the display panel 100, using a control signal received from an external source (not shown). The control signal may include a synchronization signal. The synchronization signal may include a vertical synchronization signal, a horizontal synchronization signal, a main clock signal and a data enable signal. The vertical synchronization signal represents a time required for displaying one frame. The horizontal synchronization signal represents a time required for displaying one line of a frame. Thus, the horizontal synchronization signal includes pulses corresponding to a number of pixels included in one line. The data enable signal represents a time required for supplying the pixel with data. The timing control signal may include a clock signal, a horizontal start signal and a vertical start signal, for example.

The data compensating apparatus part compensates image data for consecutive frames in a plurality of steps, to substantially improve response characteristics of liquid crystal in the display panel 100, when the image data of the continued frames suddenly changes from a relatively low gray scale to a relatively high gray scale. The data compensating apparatus part 200 converts the image data of a present frame to pre-compensation data of the present frame with a higher gray scale or, alternatively, a lower gray scale than the higher gray scale. Also, the data compensating part 200 compares the image data of the present frame with the pre-compensation data to generate a compensation data having a gray scale higher than a gray scale of the image data of the present frame.

In an exemplary embodiment, the data compensating part 200 generates the n-th pre-compensation data Gp(n) using the n-th image data G(n) and generates the n-th compensation data G'(n) using the n-th image data G(n) and an (n−1)-th pre-compensation data Gp(n−1). The n-th pre-compensation data Gp(n) is generated by using the n-th image data G(n) and the (n−1)-th pre-compensation data Gp(n−1).

Referring to FIG. 4, when the image data is 8-bit image data, the (n−1)-th pre-compensation data Gp(n−1) corresponding to previous received frame data is a zero gray scale, and the n-th image data G(n) corresponding to present received frame data is a 240 gray scale, for example, the data compensating part 200 generates the n-th pre-compensation data Gp(n) at a 112 gray scale, e.g., at a gray scale less than the n-th image data G(n) at the 240 gray scale. The data compensating part 200 generates the n-th compensation data G'(n) at a 255 gray scale, e.g., at a gray scale greater than the n-th image data G(n) at the 240 gray scale, using the (n−1)-th pre-compensation data Gp(n−1) at the zero gray scale. Similarly, the (n+1)-th image data G(n+1) at the 240 gray scale generates the (n+1)-th pre-compensation data Gp(n+1)-th at a 128 gray scale using the n-th pre-compensation data Gp(n) at the 112 gray scale, and generates the (n+1)-th compensation data G'(n+1) at a 248 gray scale, using the (n+1)-th image data G(n+1) at the 128 gray scale and the (n+1)-th pre-compensation data Gp(n).

Thus, as shown in FIG. 4, the data compensating part 200 gradually increases the pre-compensation data Gp until the pre-compensation data Gp converges to the gray scale of the n-th image data, as in the (n+6)-th frame in FIG. 4. Likewise, the data compensating part 200 gradually reduces using the compensation data G' until the n-th compensation data G'(n) converges to the gray scale of the n-th image data in frame (n+6). Accordingly, rising bounce characteristics of the liquid crystal in the display panel 100 according to an exemplary embodiment are substantially improved by the gradually changing pre-compensation data Gp and/or compensation data G'.

In an exemplary embodiment, the data driving part 140 converts the n-th compensation data G'(n) compensated in the data compensating part 200 into an analog data voltage to output the analog data voltage to the data lines DL of the display panel 100.

The gate driving part 160 synchronizes with the output of the analog data voltage from the data driving part 140 to output gate signals to the gate lines GL of the display panel 100.

Figure 5:
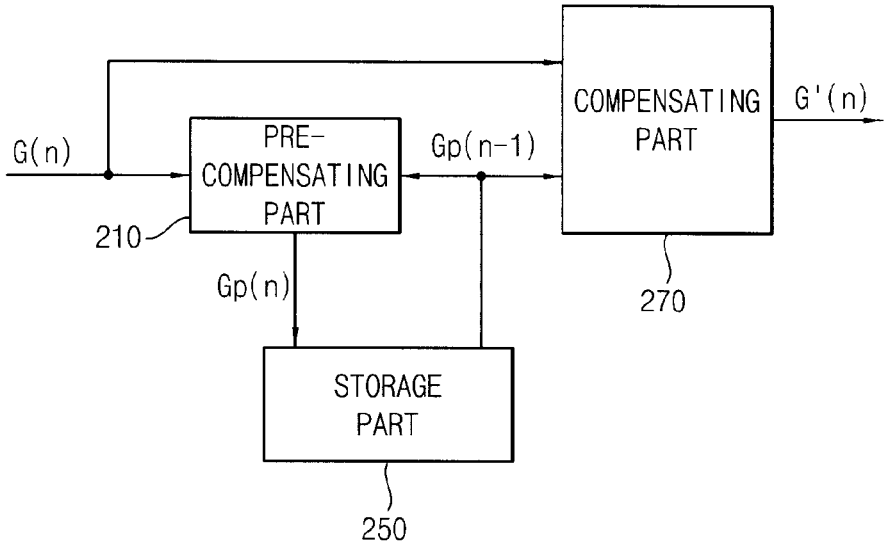
FIG. 5 is a block diagram of an exemplary embodiment of the data compensating part shown in FIG. 3.

FIG. 5 is a block diagram of an exemplary embodiment of the data compensating part 200 shown in FIG. 3.

Referring to FIGS. 3 and 5, the data compensating part 200 includes a pre-compensating part 210, a storage part 250 and a compensating part 270.

The pre-compensating part 210 generates the n-th pre-compensation data Gp(n) using the (n−1)-th pre-compensation data Gp(n−1) generated based on the n-th image data G(n) and the previous (n−1)-th image data G(n−1). In an exemplary embodiment, the pre-compensating part 210 includes a lookup table ("LUT") in which the n-th pre-compensation data Gp(n) is mapped, corresponding to the n-th image data G(n) and the (n−1)-th pre-compensation data Gp(n−1). The gray scale of the n-th pre-compensation data Gp(n) may change, as shown in FIG. 4, to various steps during consecutive frames, and have an increasingly lower gray scale (or the same gray scale) than the gray scale of the n-th image data G(n) of the n-th frame.

The storage part 250 stores the n-th pre-compensation data Gp(n) generated in the pre-compensating part 210. In an exemplary embodiment, the storage part 250 stores data based on frame units.

The compensating part 270 generates the n-th compensation data G'(n) using the n-th image data G(n) and the (n−1)-th pre-compensation data Gp(n−1). In an exemplary embodiment, the compensating part 270 includes an LUT in which the n-th compensation data G'(n) is mapped corresponding to the n-th image data G(n) and the (n−1)-th pre-compensation data Gp(n−1). More particularly, the compensating part 270 includes a LUT in which a dynamic capacitance compensation ("DCC") technology is utilized. The gray scale of the n-th compensation data G'(n) may change to various steps, and have the same or higher gray scale than the gray scale of the image data of the n-th frame, as shown in FIG. 4.

Figure 6:
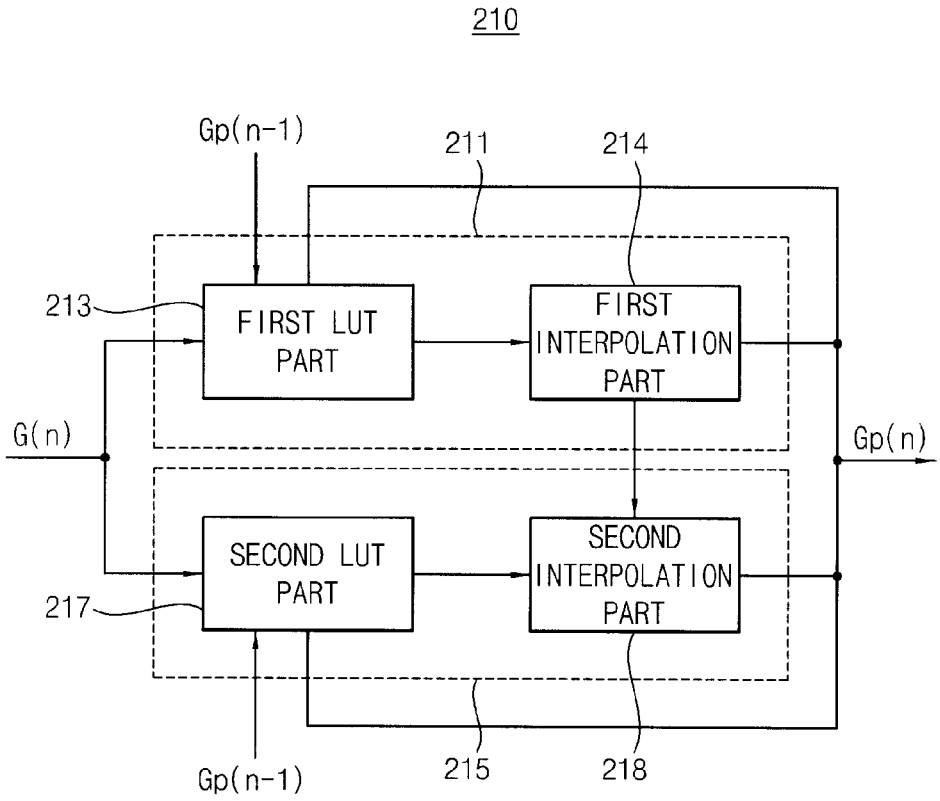
FIG. 6 is a block diagram of an exemplary embodiment of a pre-compensating part of the data compensating part shown in FIG. 5.
Figure 7:
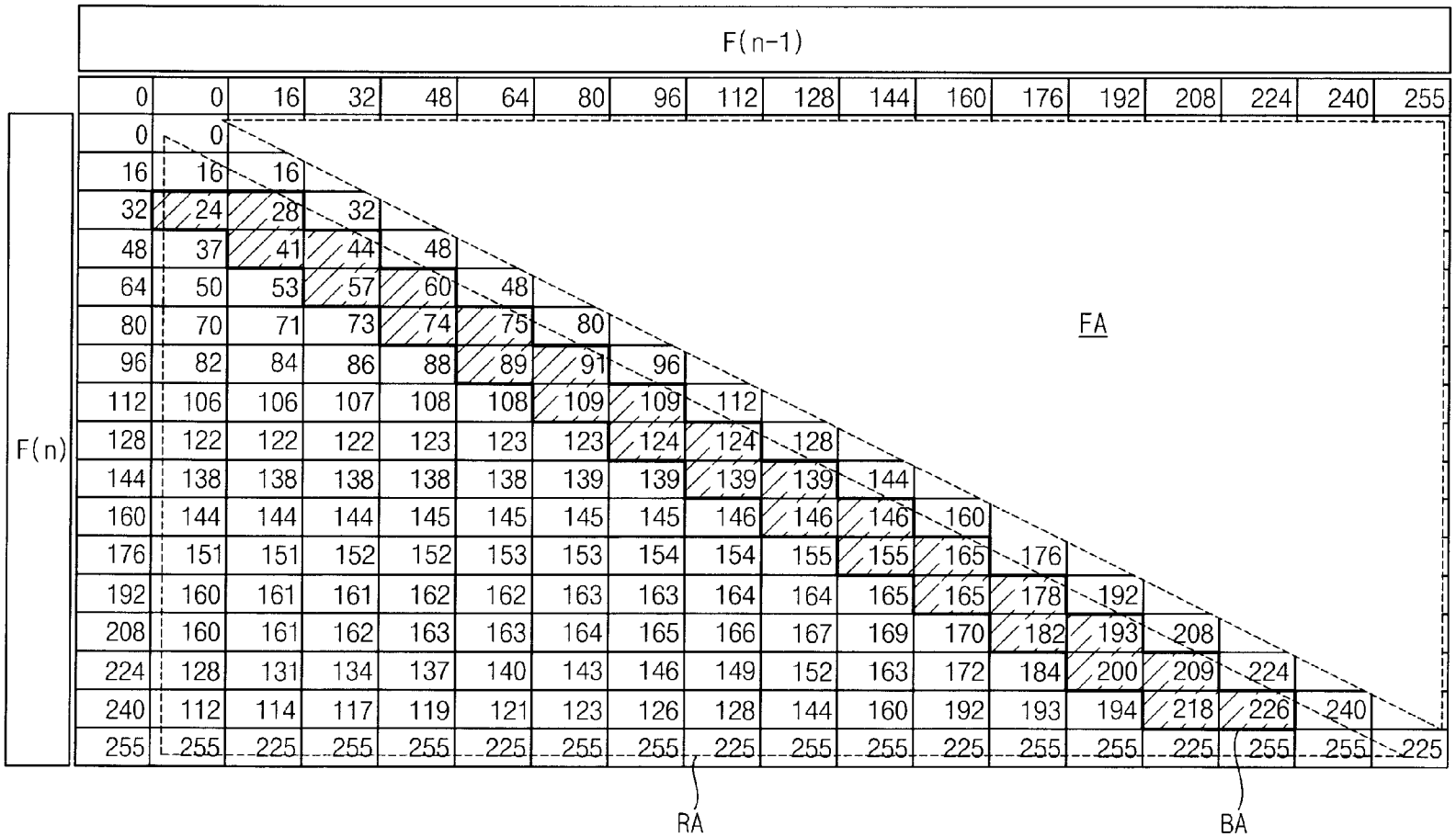
FIG. 7 is an exemplary embodiment of a first lookup table ("LUT") part of the data compensating part shown in FIG. 5.
Figure 9:
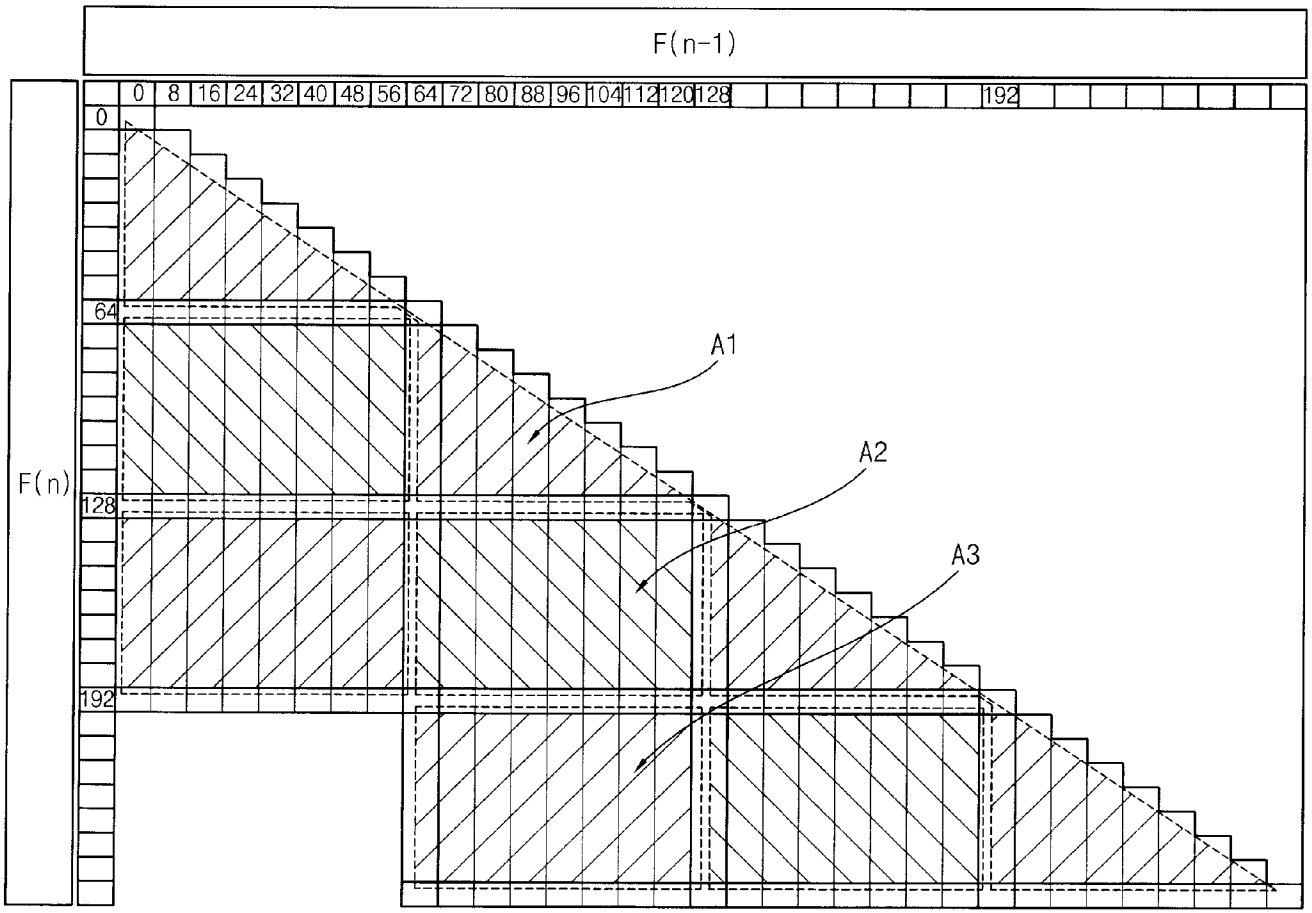
FIG. 9 is an enlarged view of a boundary area of the second LUT shown in FIG. 8.

FIG. 6 is a block diagram of an exemplary embodiment of a pre-compensating part of the data compensating part shown in FIG. 5. FIG. 7 is an exemplary embodiment of a first LUT part of the data compensating part shown in FIG. 5. FIG. 8 is an exemplary embodiment of a second LUT part of the data compensating part shown in FIG. 5. FIG. 9 is an enlarged view of a boundary area of the second LUT shown in FIG. 8.

Referring to FIGS. 5 and 6, the pre-compensating part 210 includes a first compensating part 211 and a second compensating part 215. The first compensating part 211 includes a first LUT part 213 and a first interpolation part 214.

Referring to FIG. 7, the n-th pre-compensating part Gp(n) is mapped in the first LUT part 213, in correspondence with data F(n) of the n-th frame and data F(n−1) of the (n−1)-th frame sampled at a 16 gray scale interval (when the image data is an 8-bit image data, for example). Accordingly, the first LUT part 213 may have a 17×17 format. The sampled data F(n) of the n-th frame is the n-th image data G(n), and the sampled data F(n−1) of the (n−1)-th frame is the (n−1)-th pre-compensation data Gp(n−1). The first LUT part 213 is divided into a rising area RA positioned at a left side thereof, and a falling area FA positioned at a right side thereof, thereby defining a substantially diagonal reference line from an upper left corner to a lower right corner of the first LUT part 213. The rising area RA is an area in which the gray scale of the n-th image data G(n) is greater than the gray scale of the (n−1)-th pre-compensation data Gp(n−1, while the falling area FA is an area in which the gray scale of the n-th image data G(n) is less than the gray scale of the (n−1)-th pre-compensation data Gp(n−1). Thus, the n-th pre-compensation data Gp(n) in the rising area RA of the first LUT part 213 has a gray scale characteristic as described above and shown in FIG. 4.

The first compensating part 211 generates the n-th pre-compensation data Gp(n) using the first LUT part 213 when the n-th image data G(n) is in the rising area RA.

The first interpolation part 214 creates the n-th pre-compensation data Gp(n) by using a linear interpolation method in the first LUT part 213 when the n-th image data G(n) is not in the first LUT part 213. For example, when the n-th image data G(n) is a 100 gray scale disposed between a 96 gray scale and a 112 gray scale, and the (n−1)-th pre-compensation data Gp(n−1) is a 10 gray scale disposed between a 0 gray scale and a 16 gray scale, according to the first LUT part 213 as shown in FIG. 7, the first interpolation part 214 calculates the n-th pre-compensation data Gp(n) using the linear interpolation method, e.g., using an 82 gray scale mapped to the 96 gray scale and a 0 gray scale, an 84 gray scale mapped to the 96 gray scale and a 16 gray scale, a 105 gray scale mapped to a 112 gray scale and the 0 gray scale, and a 106 gray scale mapped to the 112 gray scale and the 16 gray scale.

The second compensating part 215 generates the n-th pre-compensation data Gp(n) in a boundary area BA adjacent to the falling area FA and the rising area RA. The second compensating part 215 includes a second LUT part 217 and a second interpolation part 218.

Referring FIG. 8, the second LUT part 217 has a more detailed gray scale interval than the gray scale interval of the first LUT part 213 (FIG. 7). In the second LUT part 217, using a 10-bit image data as an example, data F(n) of the n-th frame is sampled in a 64 gray scale interval, and data F(n−1) of the (n−1)-th frame is sampled in an 8 gray scale interval. Since the data F(n−1) of the (n−1)-th frame is different than the data F(n) of the n-th frame, the data F(n−1) of the (n−1)-th frame may be expressed such as Fn-128, Fn-120, Fn-112, Fn-104, . . . , Fn-8, Fn.

When the image data is an 8-bit image data, the data F(n) of the n-th frame is sampled in a 16 gray scale interval, and the data F(n−1) of the (n−1)-th frame is sampled in a 2 gray scale interval. In an exemplary embodiment, the second LUT part 217 may have the 17×17 format.

The second interpolation part 218 calculates the n-th pre-compensation data Gp(n) using the linear interpolation method in the first LUT part 213 when the n-th image data G(n) is not in the second LUT part 217.

Referring to FIG. 9, a boundary area of the second LUT part 217 is divided into a plurality of areas including a first area A1, a second area A2 and a third area A3. The first area A1 includes 4 reference data corresponding to 4 points of a rectangular shape surrounding the n-th pre-compensation data Gp(n) in the second LUT part 217. 2 upper reference data of the 4 points are on a same oblique line. The second area A2 includes 4 reference data corresponding to 4 points of a rectangular shape surrounding the n-th pre-compensation data Gp(n) in the second LUT part 217. The third area A3 includes 2 upper reference data of reference data corresponding to 4 points of a rectangular shape surrounding the pre-compensation data Gp(n) of the n-th frame in the second LUT 217, but does not include 2 lower reference data in the second LUT part 217.

For example, when data F(n) of the n-th frame of the second LUT part 217 is sampled in a 64 gray scale interval (for the 10-bit image data), and a 64 gray scale interval in the data F(n) of the n-th frame is defined as a 1 interval, the first area A1, the second area A2, and the third area A3 are defined as follows.

The first area A1 satisfies a first condition that 4 upper bits of the data F(n) of the n-th frame be 4 equal upper bits of data F(n−1) of the (n−1)-th frame and the data F(n) of the n-th frame greater than data F(n−1) of the (n−1)-th frame. The first condition may be expressed as F(n)[9:6]==F(n−1)[9:6]) and (F(n)>F(n−1). The second area A2 satisfies a second condition that the data (F(n) of the n-th frame be the 1 interval (e.g., the 64 gray scale interval corresponding to the 10-bit image data) larger than data (F(n−1) of the (n−1)-th frame. The second condition may be expressed as F(n)[9:6]+1==F(n−1)[9:6]. The third area A3 satisfies a third condition that the data F(n) of the n-th frame be 2 intervals (128 gray scale intervals) greater than data F(n−1) of the (n−1)-th frame. The third condition may be expressed as F(n)[9:6]+2==F(n−1)[9:6].

As will now be described in greater detail, the second interpolation part 218 applies different linear interpolation methods to the first area A1, the second area A2 and the third area A3 to calculate the n-th pre-compensation data Gp(n) corresponding to the n-th image data G(n) in the boundary area BA.

Figure 10A:
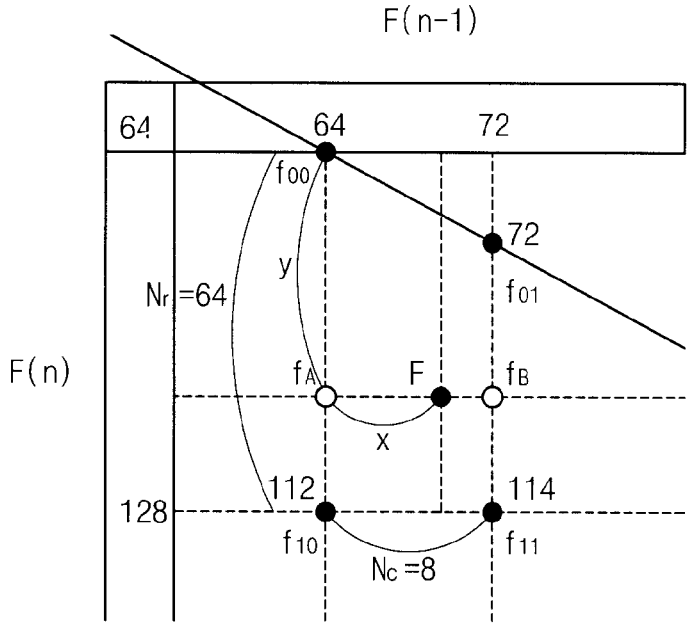
FIGS. 10A and 10B are diagrams illustrating an exemplary embodiment of a method for interpolating data disposed at a first area of the second LUT table shown in FIG. 9.
Figure 10B:
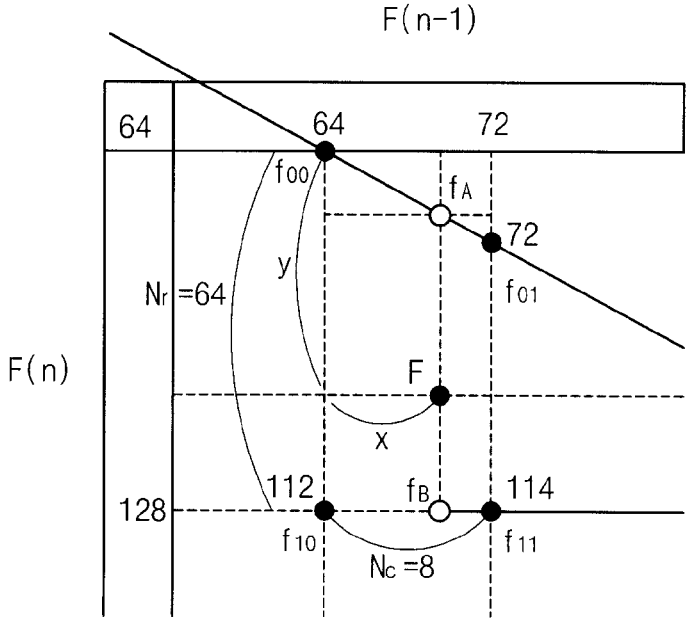

FIGS. 10A and 10B are diagrams illustrating an exemplary embodiment of a method for interpolating data disposed in a first area of the second LUT shown in FIG. 9. For purposes of description, an exemplary embodiment in which the image data is 10-bit image data will be described in further detail.

Referring to FIGS. 9 and 10A, an exemplary embodiment of a linear interpolation method for calculating the n-th pre-compensation data (labeled "F" in FIGS. 10A-12) positioned in the first area A1 is as follows.

A first data $f_A$ and a second data $f_B$ disposed on a same straight line with the pre-compensation data F of the n-th frame are calculated. The first data $f_A$ and the second data $f_B$ are disposed on a horizontal straight line. The first data $f_A$ and the second data $f_B$ are calculated using first reference data $f_{00}$, second reference data $f_{10}$, third reference data $f_{01}$ and fourth reference data $f_{11}$ stored in the second LUT part 217. More particularly, the first reference data $f_{00}$, the second reference data $f_{10}$, the third reference data $f_{01}$ and the fourth reference data $f_{11}$ are the n-th pre-compensation data stored in the second LUT part 217.

The first data $f_A$ and the second data $f_B$ are calculated by Equation 1.

$$f_A = f_{00} + \frac{y}{N_r} \times (f_{10} - f_{00}) \qquad \text{[Equation 1]}$$

$$f_B = f_{01} + \frac{y - N_c}{N_r - N_c} \times (f_{11} - f_{01})$$

The n-th pre-compensation data F is calculated by Equation 2 using the first data $f_A$ and the second data $f_B$ calculated by Equation 1.

$$F = f_{00} + (f_{01} - f_{00}) \times \frac{x}{N_c} \times (f_{10} - f_{00}) \times \frac{y}{N_r} + (f_{11} - f_{01}) \times \frac{x(y - N_c)}{N_c(N_r - N_c)} - (f_{10} - f_{00}) \times \frac{xy}{N_r N_c} \quad \text{[Equation 2]}$$

Nr is a gray scale interval of the second LUT part 217 corresponding to a row direction therein, and Nc is a gray scale interval of the second LUT part 217 corresponding to a column direction therein. For example, using the second LUT part 217 (FIG. 8), Nr is 64, and Nc is 8. In FIG. 10A, x is a gray scale interval in an x-axis direction by a position of the n-th pre-compensation data F from each of the first reference data $f_{00}$, the second reference data $f_{10}$, the third reference data $f_{01}$ and the fourth reference data $f_{11}$. In addition, y is a gray scale interval in a y-axis direction of a position of the n-th pre-compensation data F from each of the first reference data $f_{00}$, the second reference data $f_{10}$, the third reference data $f_{01}$, and the fourth reference data $f_{11}$.

Referring FIGS. 9 and 10B, an exemplary embodiment of a linear interpolation method for calculating the n-th pre-compensation data F positioned in the first area A1 is as follows.

First, the first data $f_A$ and the second data $f_B$, disposed on the same straight line as the pre-compensation data F of the n-th frame are calculated. The first data $f_A$ and the second data $f_B$ are disposed on a vertical straight line. The first data $f_A$ and the second data $f_B$ are calculated using first reference data $f_{00}$, second reference data $f_{10}$, third reference data $f_{01}$ and fourth reference data $f_{11}$ stored in the second LUT part 217.

The first data $f_A$ and the second data $f_B$ are calculated by Equation 3.

$$f_A = f_{00} + x \quad \text{[Equation 3]}$$
$$f_B = f_{10} + \frac{x}{N_c} \times (f_{11} - f_{10})$$

Then, the n-th pre-compensation data F is calculated by Equation 4 using the first data $f_A$ and the second data $f_B$ calculated by Equation 1.

$$F = f_{00} + x - (f_{10} - f_{00}) \times \frac{x}{N_r - x} + (f_{10} - f_{00}) \times \frac{y}{N_r - x} + (f_{11} - f_{10} - N_c) \times \frac{xy}{(N_r - x)N_c} - (f_{11} - f_{10} - N_c) \times \frac{x^2}{(N_r - x)N_c} \quad \text{[Equation 4]}$$

Figure 11:
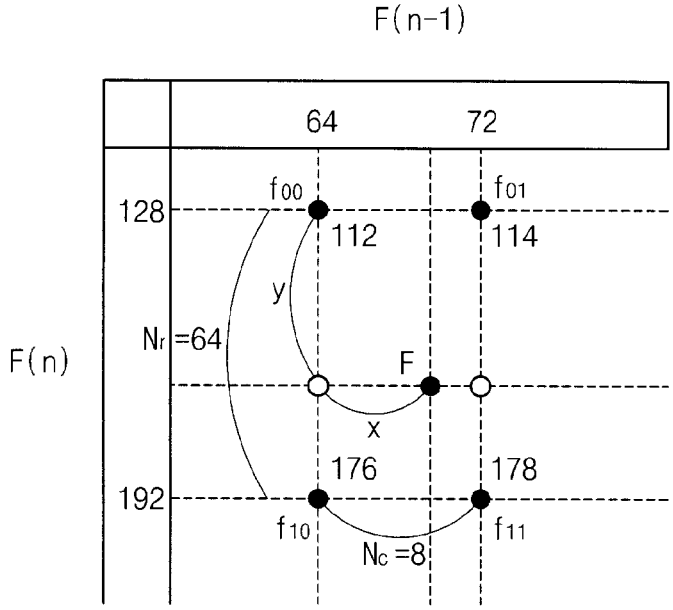
FIG. 11 is a diagram illustrating an exemplary embodiment of a method for interpolating data disposed at a second area of the second LUT table shown in FIG. 9.

FIG. 11 is a diagram illustrating an exemplary embodiment of a method for interpolating data disposed at a second area of the second LUT shown in FIG. 9.

Referring to FIGS. 9 and 11, the n-th pre-compensation data F exists on positions changed only in an x-axis direction (x) and a y-axis direction (y) with respect to each of the first reference data $f_{00}$, the second reference data $f_{10}$, the third reference data $f_{01}$ and the fourth reference data $f_{11}$ stored in the second LUT part 217.

The linear interpolation method for calculating the n-th pre-compensation data F disposed in the second area A2 is by Equation 5.

$$F = f_{00} + (f_{01} - f_{00}) \times \frac{x}{N_c} + (f_{10} - f_{00}) \times \frac{y}{N_r} + (f_{00} + f_{11} - f_{01} - f_{10}) \times \frac{xy}{N_r N_c} \quad \text{[Equation 5]}$$

Figure 12:
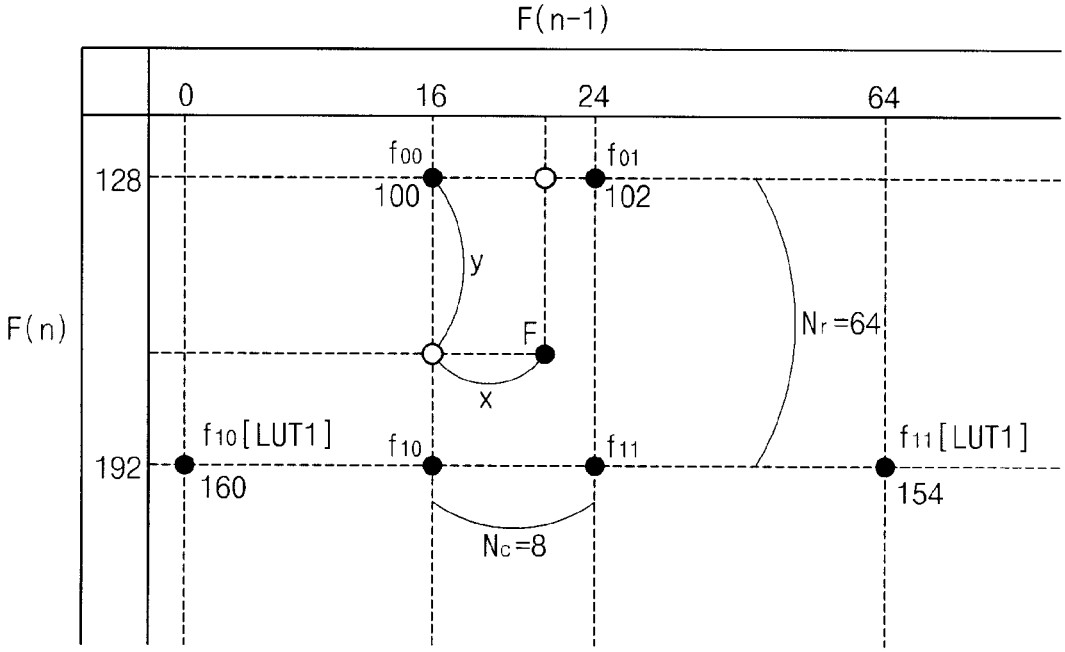
FIG. 12 is a diagram illustrating an exemplary embodiment of a method for interpolating data disposed at a third area of the second LUT table shown in FIG. 9.

FIG. 12 is a is a diagram illustrating an exemplary embodiment of a method for interpolating data disposed in a third area of the second LUT shown in FIG. 9.

Referring to FIGS. 9 and 12, the n-th pre-compensation data F may be calculated using Equation 5 above, using the first reference data $f_{00}$, the second reference data $f_{10}$, the third reference data $f_{01}$ and the fourth reference data $f_{11}$. However, the second reference data $f_{10}$ and the fourth reference data $f_{11}$ are not stored in the second LUT part 217.

For example, when the n-th pre-compensation data F corresponds to a 170 gray scale disposed between the 128 gray scale and the 192 gray scale of the n-th frame and a 22 gray scale disposed between the 16 gray scale and the 24 gray scale of the (n−1)-th frame, the first reference data $f_{00}$ and the third reference data $f_{01}$ are stored in the second LUT part 217, but the second reference data $f_{10}$ and the fourth reference data $f_{11}$ are not stored in the second LUT part 217. Referring to the second LUT part 217 of FIG. 8, when the data of the n-th frame has the 192 gray scale, the data of the (n−1)-th frame is (192-128), e.g., the compensation data corresponding to an 8 gray scale interval from the 70 gray scale. Accordingly, since the data of the (n−1)-th frame corresponds to a gray scale less than the gray scale in the second LUT part 217, the second reference data $f_{10}$ and the fourth reference data $f_{11}$ are not in the second LUT part 217.

When the reference data is not in the second LUT part 217, the first compensating part 211 calculates the second reference data $f_{10}$ and the fourth reference data $f_{11}$ which is not in the second LUT part 217, using the linear interpolation method described above. The first LUT part 213 generates a fifth reference data $f_{10[LUT1]}$ and a sixth reference data $f_{11[LUT1]}$ adjacent to the second reference data $f_{10}$ and the fourth reference data $f_{11}$ and on the same straight line therewith, *and* the first interpolation part 214 calculates the second reference data $f_{10}$ and the fourth reference data $f_{11}$ using the linear interpolation method and the fifth reference data $f_{10[LUT1]}$ and sixth reference data $f_{11[LUT1]}$.

Thus, the second interpolation part 218 calculates the n-th pre-compensation data F using the first reference data $f_{00}$ and the third reference data $f_{01}$ generated from the second LUT part 217 and the second reference data $f_{10}$ and the fourth reference data $f_{11}$ generated from the first compensating part 211, using Equation 5.

Thus, as described above and shown in FIGS. 10A to 12, the pre-compensating part 210 generates the n-th pre-compensation data Gp(n) corresponding to the n-th image data G(n). The n-th pre-compensation data Gp(n) is used to generate the n-th compensation data G'(n).

Figure 13A:
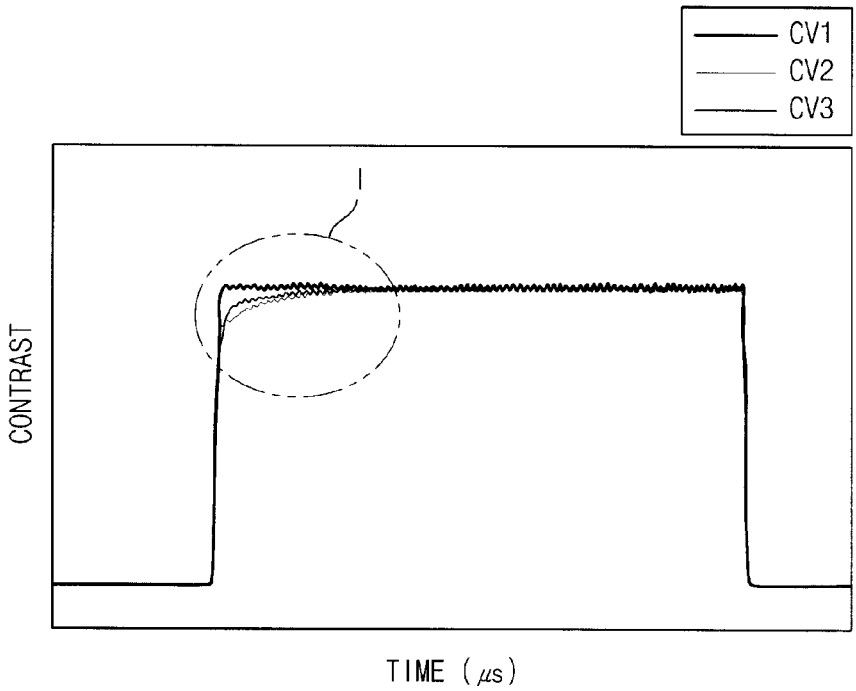
FIG. 13A is a graph of contrast versus time showing rising response characteristics of liquid crystal driven by an exemplary embodiment of a driving method according to the present invention.
Figure 13B:
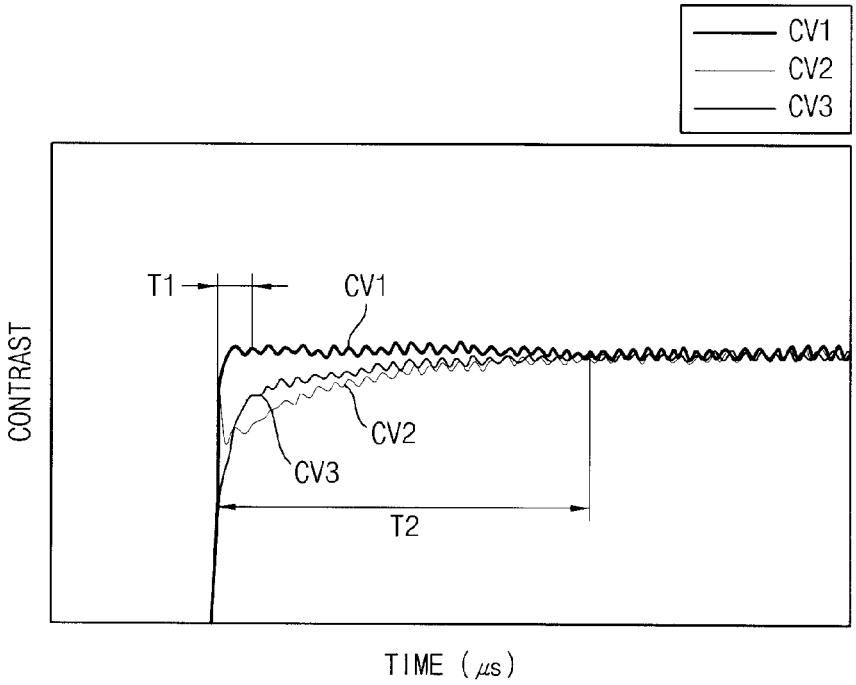
FIG. 13B is an enlarged view of portion I of FIG. 13A.

FIG. 13A is a graph of contrast versus time illustrating rising response characteristics of liquid crystal driven by an exemplary embodiment of a driving method according to the present invention. FIG. 13B is an enlarged view of portion I of FIG. 13A.

Referring to FIGS. 13A and 13B, the graphs therein were measured as an example in which, for an 8-bit image data, image data of the previous frame is a zero gray scale and image data of the present frame is a 224 gray scale.

In a first comparative example, a DCC technology according to the prior art in which an overshooting of the present image data at the 224 gray scale to a 255 gray scale is applied.

In a second comparative example, a 224 gray scale is used, but DCC technology is not applied.

Thus, in FIGS. 13A and 13B, a first curve CV1 represents rising response characteristics of liquid crystal when the data compensating part 200 according to an exemplary embodiment compensates the image data. A second curve CV2 represents the rising response characteristics of the liquid crystal according to the first comparative example. A third curve CV3 represents the rising response characteristics of the liquid crystal according to the second comparative example.

When the first curve CV1 to the third curve CV3 as shown in FIG. 13B are compared each other, it can be seen that the first curve CV1 requires a first time T1 to reach the 224 gray scale, while the second curve CV2 and the third curve CV3 require a second time T2, longer than the first time T1, to reach the 224 gray scale. As best shown in FIG. 13B, in comparing the second curve CV2 and the third curve CV3, the second curve CV2 rapidly reaches the 224 gray scale by an overshooting process, but a substantial rising bounce is generated afterward. On the other hand, the third curve CV3 does not have a rising bounce, but more gradually reaches the 224 gray.

However, comparing to the first curve CV1 to both the second curve CV2 and the third curve CV3, a time to reach the 224 gray scale is the shortest in an exemplary embodiment. Additionally, a rising bounce is not generated. Thus, the response characteristics of the liquid crystal according to the exemplary embodiment shown in the third curve CV3 are substantially improved.

Thus, according to exemplary embodiment described herein, when image data rapidly changes from a lower gray scale to a higher gray scale, compensation data of a present frame is generated using pre-compensation data having a gray scale which gradually increases, and rising bounce characteristics of liquid crystal are thereby substantially improved.

The present invention should not be construed as being limited to the exemplary embodiments set forth herein. Rather, these exemplary embodiments are provided so that this disclosure will be thorough and complete and will fully convey the concept of the present invention to those skilled in the art.

While the present invention has been particularly shown and described with reference to exemplary embodiments thereof, it will be understood by those of ordinary skill in the art that various changes in form and details may be made therein without departing from the spirit or scope of the present invention as defined by the following claims.

What is claimed is:

1. A method for compensating data, the method comprising:

converting image data of an n-th frame, where n is a natural number, into pre-compensation data of the n-th frame having a gray scale less than or equal to a gray scale of the image data of the n-th frame based on pre-compensation data of an (n−1)-th frame;

storing the pre-compensation data of the n-th frame; and generating compensation data of the n-th frame having a gray scale greater than or equal to the gray scale of the image data of the n-th frame by using the image data of the n-th frame and the pre-compensation data of the (n−1)-th frame.

2. The method of claim 1, wherein the converting the image data of the n-th frame into the pre-compensation data of the n-th frame comprises using a first lookup table in which the pre-compensation data of the n-th frame is mapped, corresponding to the image data of the n-th frame having a first gray scale interval and the pre-compensation data of the (n−1)-th frame having the first gray scale interval, when the image data of the n-th frame is in a rising area of the first lookup table in which the gray scale of the image data is greater than the gray scale of the pre-compensation data of the (n−1)-th frame.

3. The method of claim 2, wherein the converting the image data of the n-th frame into the pre-compensation data of the n-th frame further comprises:

using a second lookup table in which the pre-compensation data of the n-th frame is mapped corresponding to the image data of the n-th frame having the first gray scale interval and the pre-compensation data of the (n−1)-th frame having a second gray scale interval more detailed than the first gray scale interval, when the image data of the n-th frame is in a boundary area of the second lookup table adjacent to a falling area of the second lookup table in which the gray scale of the image data is less than the gray scale of the pre-compensation data of the (n−1)-th frame.

4. The method of claim 3, wherein the boundary area is divided into a plurality of areas, and the converting the image data of the n-th frame into the pre-compensation data of the n-th frame comprises calculating the pre-compensation data of the n-th frame in each area of the plurality of areas by using the second lookup table.

5. The method of claim 4, wherein the plurality of areas comprises:

a first area in which reference data corresponding to four points of a rectangular shape surrounding the pre-compensation data of the n-th frame are in the second lookup table, and two upper reference data of the reference data corresponding to the four points are on a same oblique line;

a second area in which the reference data corresponding to the four points of the rectangular shape surrounding the pre-compensation data of the n-th frame are in the second lookup table; and a third area in which two upper reference data corresponding to the four points of the rectangular shape surrounding the pre-compensation data of the n-th frame are in the second lookup table and two lower reference data of the reference data corresponding to the four points are not in the second lookup table.

6. A data compensating apparatus comprising:

a pre-compensating part which converts image data of an n-th frame, where n is a natural number, into pre-compensation data of the n-th frame having a gray scale less than or equal to a gray scale of the image data of the n-th frame based on pre-compensation data of an (n−1)-th frame;

a storage part which stores the pre-compensation data of the n-th frame; and a compensating part which generates compensation data of the n-th frame having a gray scale greater than or equal to the gray scale of the image data of the n-th frame by using the image data of the n-th frame and the pre-compensation data of the (n−1)-th frame.

7. The data compensating apparatus of claim 6, wherein the pre-compensating part comprises:

a first compensating part which generates the pre-compensation data of the n-th frame by using a first lookup table in which the pre-compensation data of the n-th frame is mapped corresponding to the image data of the n-th frame having a first gray scale interval and the pre-compensation data of the (n−1)-th frame having the first gray scale interval when the image data of the n-th frame is in a rising area of the first lookup table in which the gray scale of the image data is greater than the gray scale of the pre-compensation data of the (n−1)-th frame; and a second compensating part which generates the pre-compensation data of the n-th frame by using a second lookup table in which the pre-compensation data of the n-th frame is mapped corresponding to the image data of the n-th frame having the first gray scale interval and the pre-compensation data of the (n−1)-th frame having a second gray scale interval more detailed than the first gray scale interval when the image data of the n-th frame is in a boundary area of the second lookup table adjacent to a falling area of the second lookup table in which the gray scale of the image data is less than the gray scale of the pre-compensation data of the (n−1)-th frame.

8. The data compensating apparatus of claim 7, wherein the second compensating part divides the boundary area of the second lookup table into a plurality of areas and calculates the pre-compensation data of the n-th frame in each area of the plurality of areas by using the second lookup table.

9. The data compensating apparatus of claim 8, wherein the plurality of areas comprises:

a first area in which reference data corresponding to four points of a rectangular shape surrounding the pre-compensation data of the n-th frame are in the second lookup table, and two upper reference data of the reference data corresponding to the four points are on a same oblique line;

a second area in which the reference data corresponding to the four points of the rectangular shape surrounding the pre-compensation data of the n-th frame are in the second lookup table; and a third area in which two upper reference data corresponding to the four points of the rectangular shape surrounding the pre-compensation data of the n-th frame are in the second lookup table and two lower reference data of the reference data corresponding to the four points are not in the second lookup table.

10. A display apparatus comprising:

a display panel which displays an image;

a data compensating part comprising:

a pre-compensating part which converts image data of an n-th frame, where n is a natural number, into pre-compensation data of the n-th frame having a gray scale less than or equal to a gray scale of the image data of the n-th frame based on pre-compensation data of an (n−1)-th frame;

a storage part which stores the pre-compensation data of the n-th frame; and a compensating part which generates compensation data of the n-th frame having a gray scale greater than or equal to the gray scale of the image data of the n-th frame by using the image data of the n-th frame and the pre-compensation data of the (n−1)-th frame;

a data driving part which converts the compensation data of the n-th frame into an analog data signal and outputs the analog data signal to the display panel; and a gate driving part which outputs a gate signal to the display panel in synchronization with the output of the analog data signal from the data driving part.

11. The display apparatus of claim 10, wherein the pre-compensating part comprises:

a first compensating part which generates the pre-compensation data of the n-th frame by using a first lookup table in which the pre-compensation data of the n-th frame is mapped corresponding to the image data of the n-th frame having a first gray scale interval and the pre-compensation data of the (n−1)-th frame having the first gray scale interval when the image data of the n-th frame is in a rising area of the first lookup table in which the gray scale of the image data is greater than the gray scale of the pre-compensation data of the (n−1)-th frame; and a second compensating part which generates the pre-compensation data of the n-th frame by using a second lookup table in which the pre-compensation data of the n-th frame is mapped corresponding to the image data of the n-th frame having the first gray scale interval and the pre-compensation data of the (n−1)-th frame having a second gray scale interval more detailed than the first gray scale interval when the image data of the n-th frame is in a boundary area of the second lookup table adjacent to a falling area of the second lookup table in which the gray scale of the image data is less than the gray scale of the pre-compensation data of the (n−1)-th frame.

12. The display apparatus of claim 11, wherein the second compensating part divides the boundary area of the second lookup table into a plurality of areas and calculates the pre-compensation data of the n-th frame in each area of the plurality of areas by using the second lookup table.

13. The display apparatus of claim 12, wherein the plurality of areas comprises:

a first area in which reference data corresponding to four points of a rectangular shape surrounding the pre-compensation data of the n-th frame are in the second lookup table, and two upper reference data of the reference data corresponding to the four points are on a same oblique line;

a second area in which the reference data corresponding to the four points of the rectangular shape surrounding the pre-compensation data of the n-th frame are in the second lookup table; and a third area in which two upper reference data corresponding to the four points of the rectangular shape surrounding the pre-compensation data of the n-th frame are in the second lookup table and two lower reference data of the reference data corresponding to the four points are not in the second lookup table.

* * * * *